United States Patent [19]

Hauf

[11] 4,056,070

[45] Nov. 1, 1977

[54] AUTOMATIC ONE-STEP BUTTONHOLING DEVICE

[75] Inventor: Robert Conrad Hauf, Upper Montclair, N.J.

[73] Assignee: The Singer Company, New York, N.Y.

[21] Appl. No.: 732,683

[22] Filed: Oct. 15, 1976

[51] Int. Cl.[2] ..... D05B 3/02

[52] U.S. Cl. ..... 112/158 B; 112/272; 112/277; 112/235

[58] Field of Search ..... 112/158 B, 158 R, 219 R, 112/219 A, 220, 235, 130, 158 A

[56] References Cited

U.S. PATENT DOCUMENTS

| | | | |
|---|---|---|---|
| 2,862,468 | 12/1958 | Johnson | 112/158 A |
| 2,910,027 | 10/1959 | Winz | 112/219 R |
| 3,596,618 | 8/1971 | Goldbach et al. | 112/158 B |
| 3,661,106 | 5/1972 | Huddelston | 112/130 |

*Primary Examiner*—H. Hampton Hunter

*Attorney, Agent, or Firm*—Robert E. Smith; Edward L. Bell

[57] ABSTRACT

An automatic buttonholing device which uses a specially modified presser foot into which electrical contacts are inserted for actuating an electromechanical buttonholing assembly. The operator places small conductive markers on the fabric at the top and bottom of the desired buttonhole location. When the contacts on the presser foot ride over the markers, a circuit is completed and proper steps in the buttonholing sequence are initiated.

3 Claims, 9 Drawing Figures

Fig.5
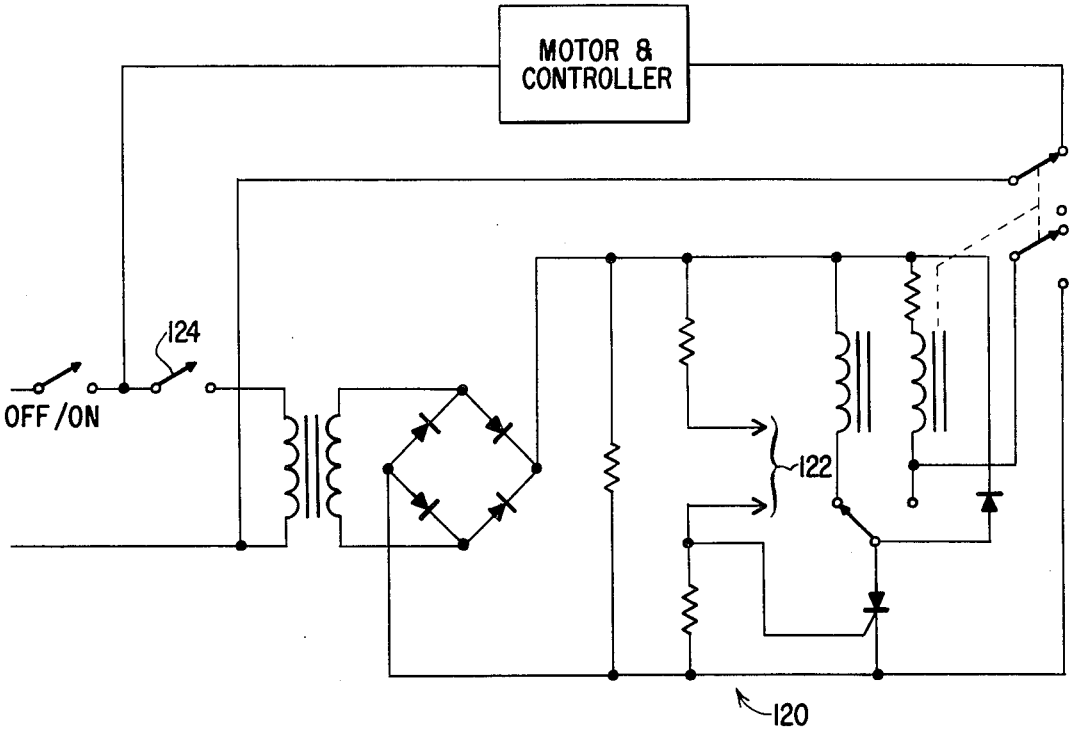
Fig.6A
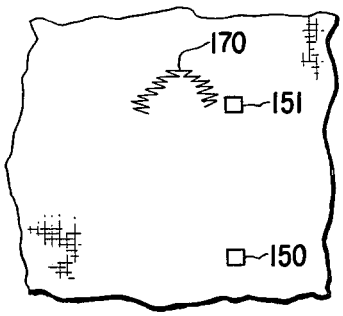
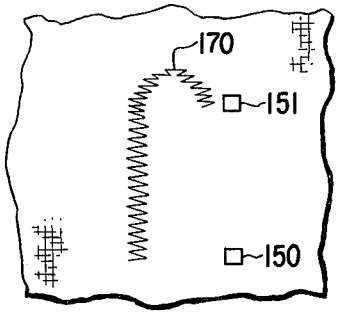
Fig.6B
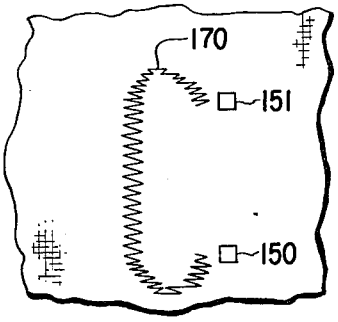
Fig.6C
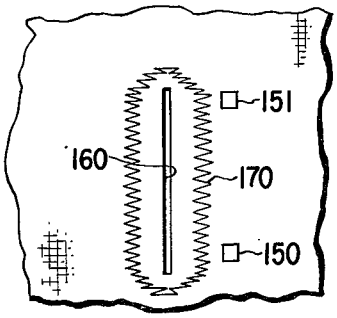
Fig.6D

AUTOMATIC ONE-STEP BUTTONHOLING DEVICE

BACKGROUND OF THE INVENTION

Automatic one-step buttonholing devices, in themselves, are not new. U.S. Pat. No. 3,596,618 by Goldbach, discloses one such device which utilizes a wheel in contact with the the workpiece for metering the size of the buttonhole being sewn. Another device disclosed in U.S. Pat. No. 3,656,443 by Ross, consists of a slide attachable to the presser bar. This slide travels along with the workpiece and through a set of linkages determines the size of the buttonhole. Both of the aforementioned devices, as well as many others, require additional, and in some cases, cumbersome hardware just for sizing the buttonhole. This additional hardware can be expensive to manufacture and may, after use, require calibration and repair. In addition, these devices place a maximum limit on the desired buttonhole.

SUMMARY OF THE INVENTION

The object of this invention is to provide a buttonholing device which is capable of measuring a buttonhole with a minimum amount of additional hardware and which places no limitation on the size of the buttonhole. These objects are achieved by placing gate means, such as two electrical contacts in close proximity of each other, on the bottom of a standard presser foot. By applying a pair of gate closing elements on the workpiece indicating the top and bottom of the buttonhole, when the gate means ride over the gate closing elements, a circuit is excited which then actuates a buttonholing assembly.

With the above and additional objects and advantages in view as will hereinafter appear, this invention will be described in reference to the accompanying drawings of the preferred embodiment.

DESCRIPTION OF THE DRAWINGS

FIG. 5 is a schematic of the electrical control circuit to which the contacts are connected.

FIGS. 6A, 6B, 6C and 6D show in sequential steps the formation of a buttonhole.

DESCRIPTION OF THE PREFERRED EMBODIMENT

Figure 1:
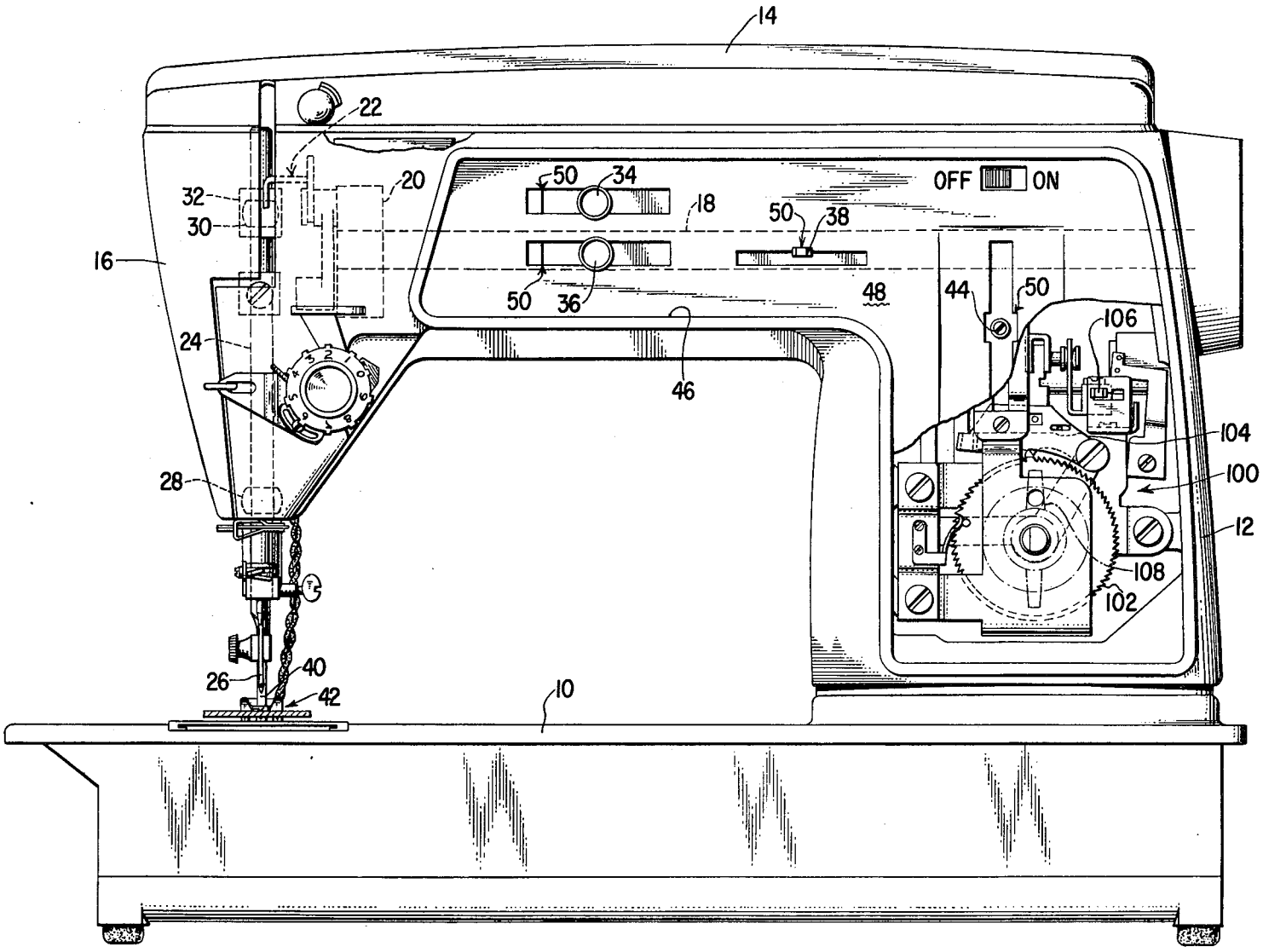
FIG. 1 is a front elevation of a sewing machine having the invention incorporated therein.

The buttonholing device of this invention, as illustrated in FIG. 1, is embodied in a zig-zag vertical cam stack sewing machine which comprises a frame including a bed 10, a hollow-standard 12 rising from the bed 10, a bracket arm 14 extending from the hollow-standard 12 and terminating in a sewing head 16 which overhangs the bed 10. Journaled in the bracket arm 14 is a main shaft 18 which carries a balance wheel 20. A drive motor (not shown) is preferably carried within the rear portion of the hollow-standard 12.

Within the sewing head 16, the main shaft 18 carries a conventional crank mechanism 22 for imparting endwise reciprocating motion to a needle bar 24 to the end of which a needle 26 is clamped. To provide for zig-zag stitching, the needle bar 24 is endwise slidable in a spherical bearing 28 in the lower extremity of the sewing head 16 and is slidably constrained in a similar spherical bearing 30 in a gate 32 to which is imparted a lateral jogging motion by a needle jogging mechanism (not shown). The needle jogging mechanism includes provisions for controlling the neutral position of needle vibration, and provides for the sewing of cam controlled patterns of zig-zag stitching, having controls 34 and 36 for adjusting the same. Handle 38 is provided for adjusting the bight of the needle jogging mechanism.

Also located within the sewing head is a presser bar 40 which is spring biased toward the material being sewn. Pivotally attached to the end of the presser bar 40 is a sensing presser foot assembly 42 which forms a part of this invention.

Cooperating with the needle 26 in the formation of stitches is a conventional loop taker (not shown) which may be driven in timed relation with the needle reciprocation by means connecting the looptaker with the main shaft 18. Also driven from the main shaft 18 is a work-feeding mechanism (not shown) having a regulating handle 44 attached thereto for adjusting both the direction and length of feed for each stitch.

In the sewing machine, the standard 12 and the bracket arm 14 are formed in the front wall with an opening 46 which is closed by a cover 48 through which the controls 34 and 36 for cam follower position selection, controller 38 for width of zig-zag stitching and the feed-regulating handle 44 project. Any desired indicia may be provided on the cover 48 for facilitating the setting of the controls, and as illustrated in FIG. 1, special indicia 50 may be provided to facilitate the settings necessary for use of the buttonholing device.

The construction of the sewing machine thus far described is similar to that described in greater detail in U.S. Pat. No. 2,862,468 by Johnson, which is modified to include the cam follower position selecting mechanism which is described in greater detail in U.S. Pat. No. 3,503,530 by Buan, to both of which reference may be had.

The buttonholing device, as shown in FIG. 1, comprises a sensing presser foot assembly 42 which provides sensing pulses at pre-set intervals, a buttonholing assembly 100 coupled to the sewing machine controls, having a repetitive sequence of modes of operation, each of which results in the stitching of a discrete portion of a buttonhole, and an indexing mechanism which, upon activation, advances the buttonholing assembly 100 from one mode to the next, and an electrical control circuit 120 having a first stage for detecting sensing pulses from the presser foot assembly 42 and a second stage for activating the indexing mechanism of the buttonholing assembly 100.

The buttonholing assembly 100 and the electrical control circuit 120 are the same as that described in U.S. Pat. No. 3,596,618 by Goldbach et al, to which reference may be had for greater detail.

Figure 2:
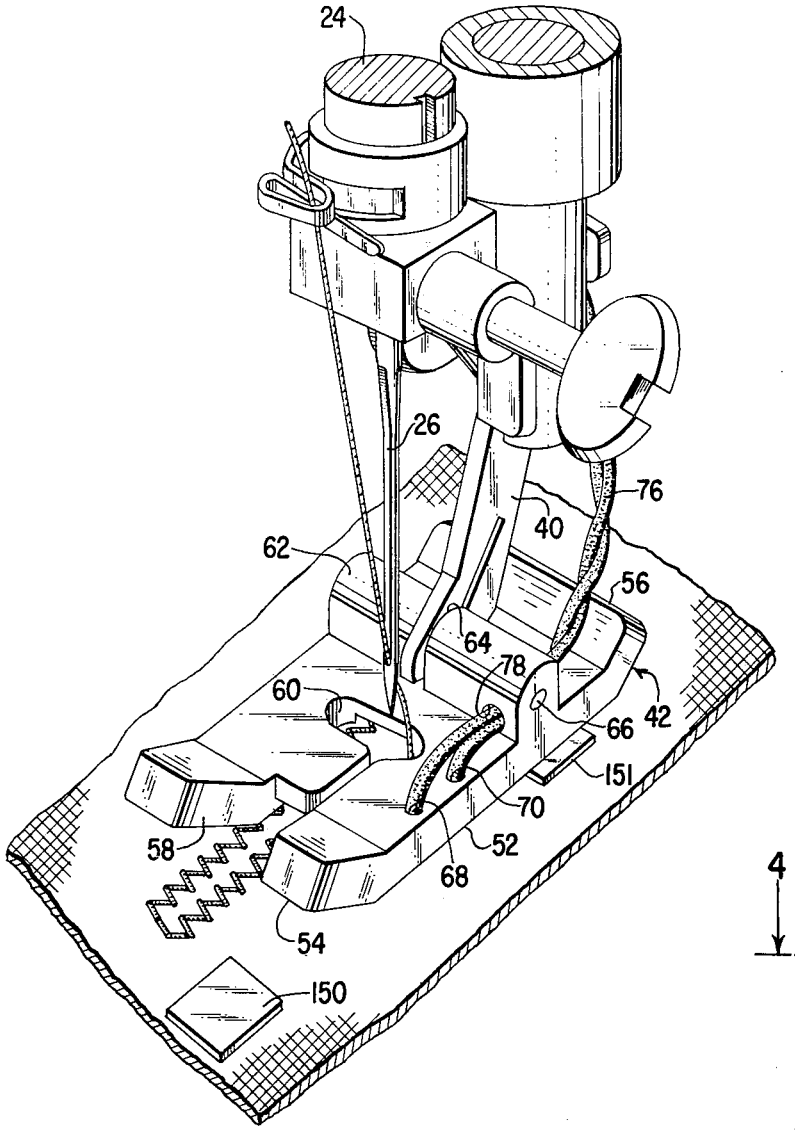
FIG. 2 is a top perspective view of sewing machine presser foot with the electrical contacts of the invention installed. Also shown is the relative positioning of the pieces of conductive material on the work piece.
Figure 4:
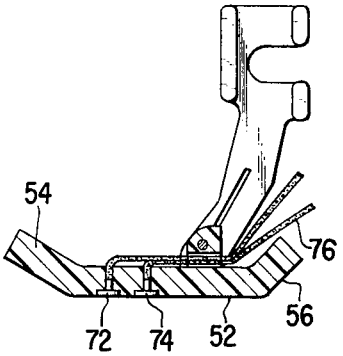
FIG. 4 is a cross-sectional view of the presser foot taken along line 4—4 of FIG. 3.
Figure 3:
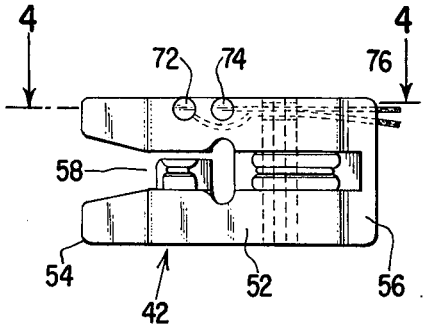
FIG. 3 is a bottom view of the presser foot showing the electrical contact in position.

As shown in FIGS. 2, 3, and 4, the presser foot assembly 42 comprises a base plate 52, preferably made of plastic, having a bifurcated front portion 54 and a solid rear portion 56. Both the front and rear portions, 54 and 56, respectively are turned upward to prevent the presser foot assembly 42 from catching the material being sewn.

The bifurcation 58 in the front portion 54 terminates in an enlarged sewing eye 60 located near the center of the base plate 52 through which the needle 26 travels in the formation of stitches. The base plate 52 is also formed with a boss 62 located to the rear of the sewing eye 60 transverse to the width of the base plate 52. The boss 62 has a slot 64 formed therein at its center and transverse to the slot 64 a pin 66 is secured in the boss 62 for pivotally attaching the presser foot assembly 42 to the presser bar 40.

The base plate 52 is further formed having two holes 68 and 70 in close tandem proximity of each other. The actual location of the holes 68 and 70 is not important, however, in this embodiment, the holes 68 and 70 lie to the right of and substantially adjacent to the sewing eye 60.

Two electrical contacts 72 and 74, having lead wires 76 attached thereto, are secured in the holes 68 and 70, respectively, by any suitable means, such as epoxy cement, such that the electrical contacts 72 and 74 are in contact with the material being sewn. In this embodiment, a hole 78 is formed in the boss 62 for directing the lead wires 76 out of the line of sight of the operator.

Referring to FIG. 5, the lead wires 76 are connected to the electrical control circuit 120 at the point 122.

The buttonholing assembly 100 is coupled to the sewing machine controls for feed regulation and neutral needle position by means of a cam arrangement 102 which is driven is increments by a linkage 104 connected to the feed mechanism. A lever 106 engages the buttonholing assembly 100 and activates the electrical control circuit 120 through switch 124. The lever 106 along with a knob 108, for adjusting the initial position of the cam arrangement 102, protrude through the cover 48 allowing access by the operator. Reference may be made to U.S. Pat. No. 3,596,618 for a detailed description of both the buttonholing assembly 100 and the electrical control circuit 120.

To form a buttonhole, the operator first affixes to the material two small pieces of conductive material 150 and 151 each alongside the opposite extremity of the location of the slit or hole 160 which after being edged by stitching 170 will be cut to define the buttonhole. The pieces of conductive material 150 and 151 may be metal foil having a pressure sensitive adhesive coating on one side. It will be noted in FIGS. 6A to D that the stitching 170 proceeds beyond the conductive material 150 and 151 at each end of the buttonhole. The operator then moves lever 106 engaging the buttonholing assembly 100 and then turns knob 108 to its starting position which may be marked by indicia 50 on the front cover 48. Controls 34 and 36 are also set to indicia 50 at this time.

Using the piece of conductive material 151 as a guide, the operator lowers the presser foot assembly 42 and then starts the sewing machine which automatically forms the rounded top of the buttonhole (FIG. 6A). After forming the rounded top portion, the operation of the buttonholing assembly 100 is suspended allowing the operator to sew a straight line of zigzag stitches (FIG. 6B). When the contacts 72 and 74 touch the second piece of conductive material 150, a pulse is sent out reactivating the buttonholing assembly 100 which then forms the rounded bottom portion of the buttonhole (FIG. 6C). At the completion of the rounded bottom portion, again the operation of the buttonholing assembly 100 is automatically suspended allowing the operator to sew a straight line of zigzag stitches to complete the buttonhole (FIG. 6D). To prevent overshooting the end of the buttonhole, when the contacts 72 and 74 touch the piece of conductive material 151, the sewing machine is stopped until the operator either reinitializes the buttonholing device using knob 108 or disengages the same by moving lever 106. Let it be known that although pulses are sent out by the presser foot assembly 42 when the contacts 72 and 74 touch the piece of conductive material 151 at the start of the buttonhole and at the completion of the rounded top portion and when the contacts 72 and 74 touch the second conductive piece of material 150 at the completion of the rounded bottom portion of the buttonhole, these pulses do not affect the operation of the buttonholing device.

Having thus set forth the nature of this invention what I claim herein is:

1. In a sewing machine for producing zig-zag stitching in a work piece and having a needle reciprocable in an endwise path, a mechanism for jogging said needle laterally to produce zig-zag stitches including at least one member for regulating the needle jogging motion, a work feeding mechanism including a feed regulating member having a range of position corresponding to forward and reverse direction of work feed, an actuating mechanism in said sewing machine operatively connected to impart endwise reciprocatory and lateral vibratory movements to said needle and movement to said work feeding mechanism in timed relation thereto, a presser device arranged to bear against the work piece adjacent to the path of reciprocation of said needle, a buttonholing assembly having a repetitive sequence of modes and effective in each one of said modes to influence the settings of said needle jogging and feed regulating members appropriately for the formation of a different segment of a stitched buttonhole, an indexing mechanism effective on each activation to advance said buttonholing assembly one mode in said repetitive sequence, an electrical control arrangement for said indexing mechanism comprising a circuit including an activation stage for said indexing mechanism, and gate means carried by said sewing machine presser device closely adjacent to one side of said path of needle reciprocation and effective on each closure to energize said activation stage, in combination with a pair of gate closing elements each including fastening means for temporary attachment to a work piece each to one side of the opposite extremity of the location of a buttonhole desired to be formed in said work piece.

2. An electrical control arrangement as set forth in claim 1 wherein said gate means comprises a pair of electrical contacts mounted on the underside of said sewing machine presser device whereby said contacts bear against said work piece.

3. An electrical control arrangement as set forth in claim 2 wherein said gate closing elements comprise pieces of thin metal foil having pressure sensitive adhesive applied to one side thereof whereby said adhesive will temporarily hold said pieces of metal foil to said work piece in proximity of said desired buttonhole location such that said electrical contacts will ride thereover.

* * * * *